US010717587B2

(12) United States Patent
Tarbutton

(10) Patent No.: US 10,717,587 B2
(45) Date of Patent: Jul. 21, 2020

(54) BEVERAGE CONTAINER INSULATOR

(71) Applicant: TARBUTTON TRUMP REAL ESTATE LLC, Easton, MD (US)

(72) Inventor: Charles S. Tarbutton, Easton, MD (US)

(73) Assignee: TARBUTTON TRUMP REAL ESTATE LLC, Easton, MD (US)

( * ) Notice: Subject to any disclaimer, the term of this patent is extended or adjusted under 35 U.S.C. 154(b) by 219 days.

(21) Appl. No.: 15/960,586

(22) Filed: Apr. 24, 2018

(65) Prior Publication Data

US 2019/0322440 A1 Oct. 24, 2019

(51) Int. Cl.
*B65D 81/38* (2006.01)
*A47G 23/02* (2006.01)

(52) U.S. Cl.
CPC ..... *B65D 81/3876* (2013.01); *A47G 23/0241* (2013.01); *A47G 2023/0275* (2013.01)

(58) Field of Classification Search
CPC ..... B65D 81/3876; B65D 81/3879; B65D 81/3881; A47G 23/0241; A47G 2023/0275; A47G 2023/0291; A47G 2023/0216
See application file for complete search history.

(56) References Cited

U.S. PATENT DOCUMENTS 3,779,298 A * 12/1973 Piccirilli ..... B44C 1/18 220/4.21
6,604,649 B1 * 8/2003 Campi ..... B65D 81/3886 220/592.17
7,201,285 B2 * 4/2007 Beggins ..... B65D 81/3879 215/386
D709,337 S 7/2014 Miller
D859,087 S * 9/2019 Tarbutton ..... D7/607

* cited by examiner

*Primary Examiner* — Andrew T Kirsch
*Assistant Examiner* — Don M Anderson
(74) *Attorney, Agent, or Firm* — Davis & Bjuold, P.L.L.C.; Jay Franklin

(57) ABSTRACT

A beverage container insulator for accommodating and completely enclosing a beverage container. The insulator has a base element and a cover element, each of which has an interior cavity. The base element and the cover element can be arranged in an assembled state, in which the beverage container is accommodated within the interior cavities, and an interconnected state which couples the base and the cover elements to each other. The cover element includes an insert having an outer diameter that corresponds to an inner diameter of the base element such that when the insert is inserted into the base element, the base element and insert of the cover engage each other with an interference fit.

12 Claims, 5 Drawing Sheets

FIG. 13
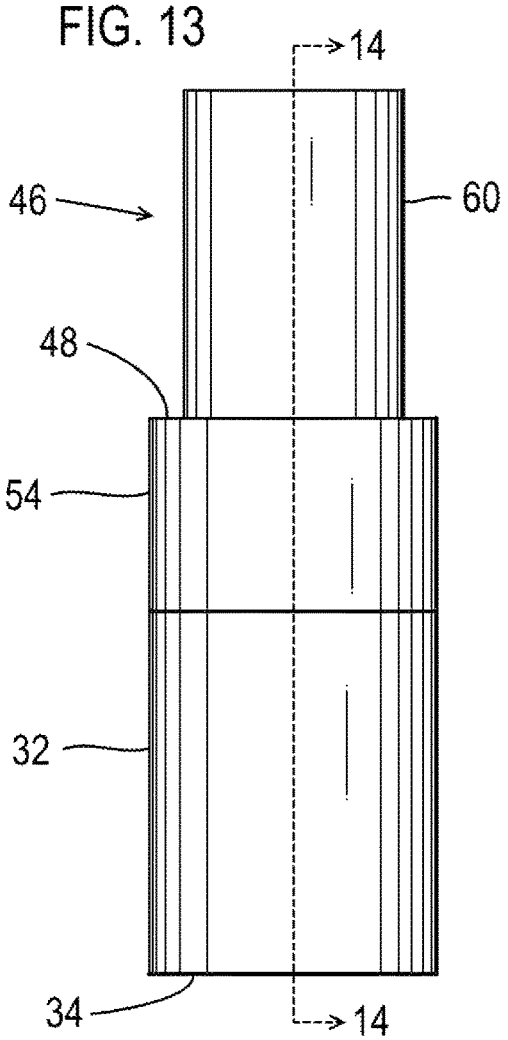
FIG. 14
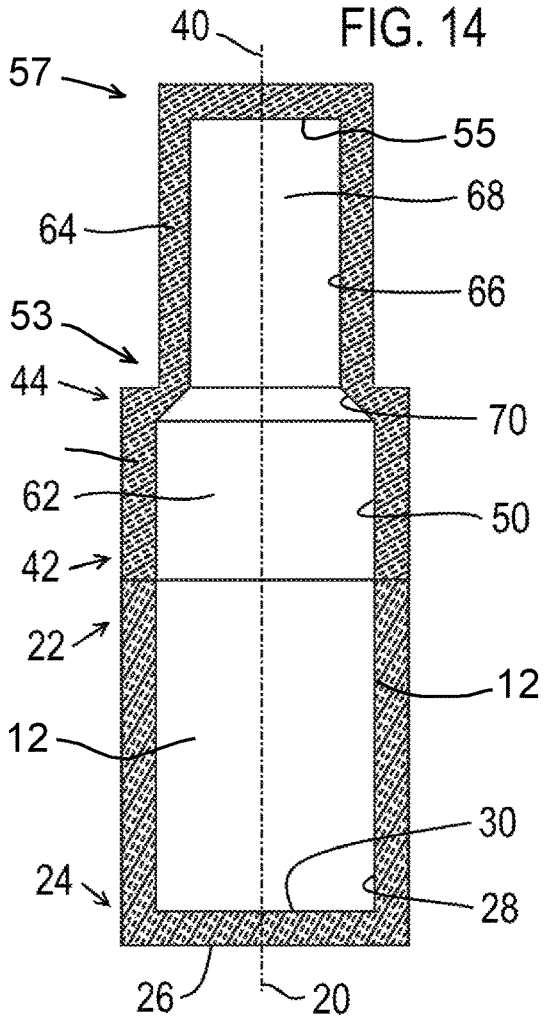
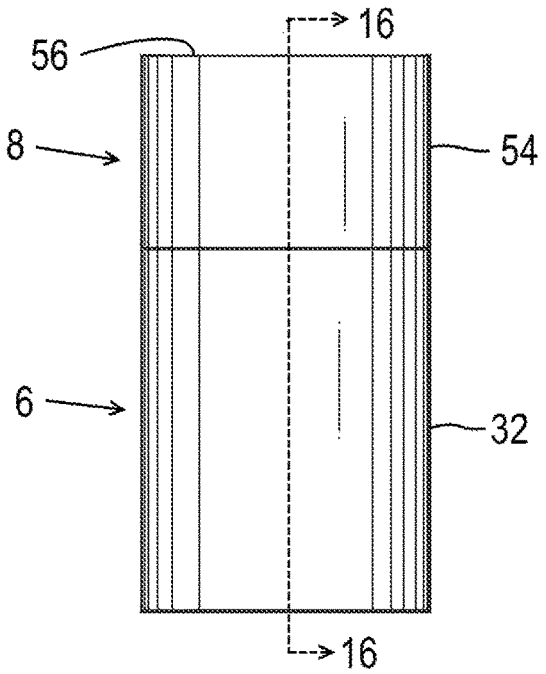
FIG. 15
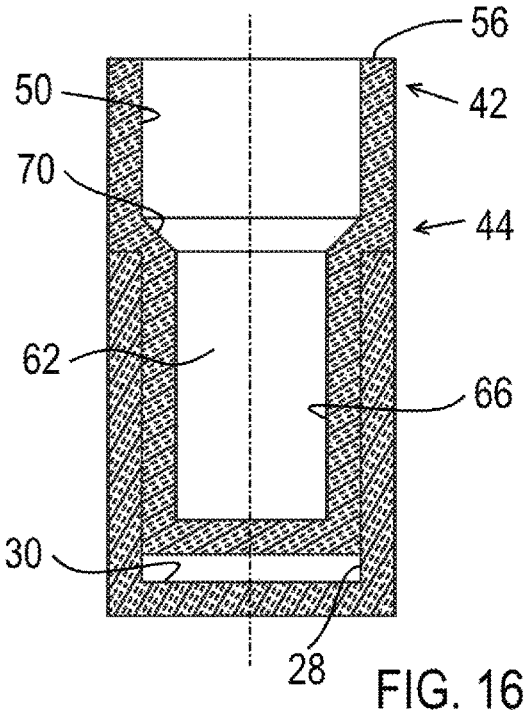
FIG. 16

BEVERAGE CONTAINER INSULATOR

FIELD OF THE INVENTION

The present invention relates to a beverage container insulator having a base portion and a cover portion which entirely enclose beverage containers, such as bottles and cans, to completely insulate the beverage container and prevent foreign objects from entering into the interior of the beverage container.

BACKGROUND OF THE INVENTION

Beverage container insulators are widely used to provide thermal insulation for beverage cans or bottles and to provide a comfortable covering for holding such a can or bottle by the consumer. One such beverage insulator is known from U.S. Design Patent. No. D709,337 which illustrates the insulator as being in the form of a cup in which the beverage container, a can or bottle, is placed. These known cup shaped insulators partially envelop the can or bottle leaving the top portion of the can or bottle exposed, allowing the consumer to drink from the open top of the beverage container. Such beverage container insulators provide a measure of insulation and are somewhat effective in maintaining the temperature of a cold or hot beverage in relation to a warm or cold environment for a period of time.

Although the know beverage container insulators may maintain the cooler temperature of a beverage just removed from a refrigerator for example, when compared to a non-insulated beverage container, because the top portion of the can or bottle is exposed to the environment, the temperature of the beverage still rises fairly rapidly.

Another drawback of the know beverage container insulators stems from the fact that, in use, the open top of the can or bottle is continually exposed to the environment. As such, over the course of consuming the beverage, crawling and/or flying bugs, insects, and other pests are able to access the beverage through the open top of the can or bottle which can cause the person drinking the beverage to become sick. With the top of the beverage container be exposed, it is also possible for foreign objects, debris or matter to enter the can or bottle such as for example by means of wind. This is generally regarded by the consumer as being unpleasant and may cause the consumer to throw out an unfinished beverage.

SUMMARY OF THE INVENTION

Wherefore, it is an object of the present invention to overcome the above mentioned shortcomings and drawbacks associated with the prior art.

Another object of the present invention is to provide an improved beverage container insulator which completely encloses a beverage container in an interior thereof thereby insulating the entire beverage container and maintaining the beverage at a fixed temperature for a longer period of time in comparison to known beverage container insulators.

A further object of the present invention is to provide an improved beverage container insulator which covers an upper portion of the beverage container thereby preventing the potential entry of crawling and/or flying bugs, insects, and other pests as well as the entry of foreign objects, debris or matter into the beverage container when the top of the beverage container is open.

Yet another object of the present invention is to provide a beverage container insulator having a base element and a cover element which entirely enclose a beverage container. The base element being in the form of a cup in which the beverage container is placed and the cover element having a form which receives the upper portion of the beverage container and mates with the base element so as to entirely enclose the beverage container. The cover element of the beverage container insulator having an insert which extends from a top surface of the cover element and which is sized to be received by base element thereby coupling the base element and the cover element when the beverage container insulator is not in use.

The present invention also relates to a beverage container insulator for accommodating a beverage container therein. The beverage container insulator comprises a base element that has a base sidewall and an end wall. The base sidewall is cylindrical and defines a longitudinal axis. The base sidewall has an open end and an axially opposite closed end that is closed by the end wall. The base sidewall and the end wall define an interior cavity. A cover element has a cylindrical cover sidewall and a cylindrical insert that define a longitudinal axis. The cover sidewall has a first end that is open and an axially opposite second end. The insert is connected to the second end of the cover sidewall and has an interior end surface. At least the interior end surface of the insert and an interior surface of the cover sidewall define an interior cavity. The cover and the base elements can be arranged in an assembled state to accommodate the beverage container within an internal chamber that is formed by the interior cavity of the base element and the interior cavity of the cover element. The cover and the base elements can also be arranged in an interconnected state so as to couple the cover element and the base element to each other. In the assembled state, the interior cavity of the base element receives a first portion of the beverage container therein and the interior cavity of the cover element receives a remaining second portion of the beverage container therein to completely enclose the beverage container within the internal chamber. In the interconnected state, the insert of the cover element is received within the interior cavity of the base element and mates with the base sidewall.

The present invention also relates to a beverage container insulator for accommodating and completely enclosing a beverage container therein. The beverage container insulator comprises a base element that has a cylindrical base sidewall which defines a longitudinal axis. The base sidewall has an open end and a closed end. The open end of the base sidewall has an annular first surface and the closed end of the base sidewall is closed by an end wall. An interior surface of the base sidewall and an interior surface of the end wall define an interior cavity of the base element. A cover element has a cylindrical cover sidewall which defines a longitudinal axis and the cover sidewall has an open first end and an axially opposite second end. The first end of the cover sidewall has an annular first end surface and the second end of the cover sidewall is integrally formed with a cylindrical insert which is coaxially aligned with the cover sidewall and axially extends from the second end of the cover sidewall in a direction opposite from the first end of the cover sidewall. The insert has an end wall that closes the second end of the cover sidewall such that an interior surface of the cover sidewall and the insert define an interior cavity of the cover element. The base element and the cover element are dimensioned such that, in an assembled state of the base element and the cover element, the first annular surface of the base sidewall mates with the first end surface of the cover sidewall, and the interior cavity of the base element and the interior cavity of the cover element form an internal chamber which receives and completely encloses an entirety of the beverage container therein. The insert has an exterior surface with an outer diameter that corresponds to an inner diameter of the interior surface of the base sidewall such that, in an interconnected state of the base element and the cover element, the insert of the cover element is received within the interior cavity of the base element and an interference fit is formed between the interior surface of the base sidewall and the exterior surface of the insert.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. The invention will now be described, by way of example, with reference to the accompanying drawings in which:

FIG. 13 is an elevation view of the second embodiment of the beverage container insulator according to the invention shown in an assembled state for accommodating a beverage container;

FIG. 14 is a cross sectional view of the second embodiment of the beverage container insulator according to the invention taken along line 14-14 of FIG. 13;

FIG. 15 is an elevation view of the second embodiment of the beverage container insulator according to the invention shown in an interconnected state;

FIG. 16 is a cross sectional view of the second embodiment of the beverage container insulator according to the invention taken along line 16-16 of FIG. 15;

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION OF THE PREFERRED EMBODIMENTS

The present invention will be understood by reference to the following detailed description, which should be read in conjunction with the appended drawings. It is to be appreciated that the following detailed description of various embodiments is by way of example only and is not meant to limit, in any way, the scope of the present invention.

Figure 4:
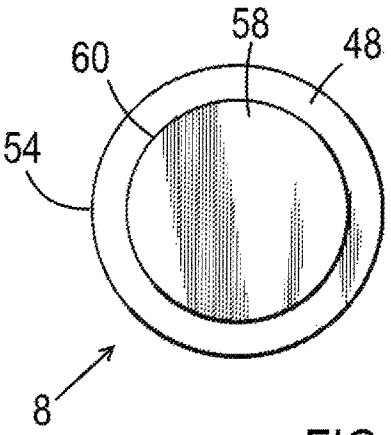
FIG. 4 is a top view of the first embodiment of the beverage container insulator according to the invention.
Figure 3:
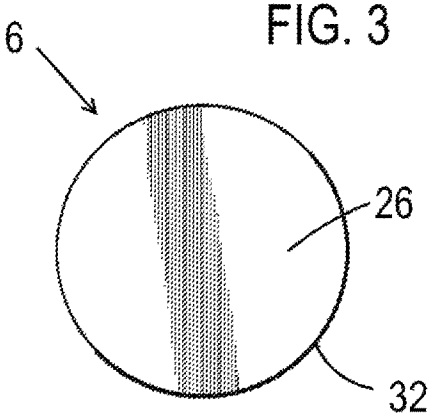
FIG. 3 is a bottom view of the first embodiment of the beverage container insulator according to the invention.
Figure 2:
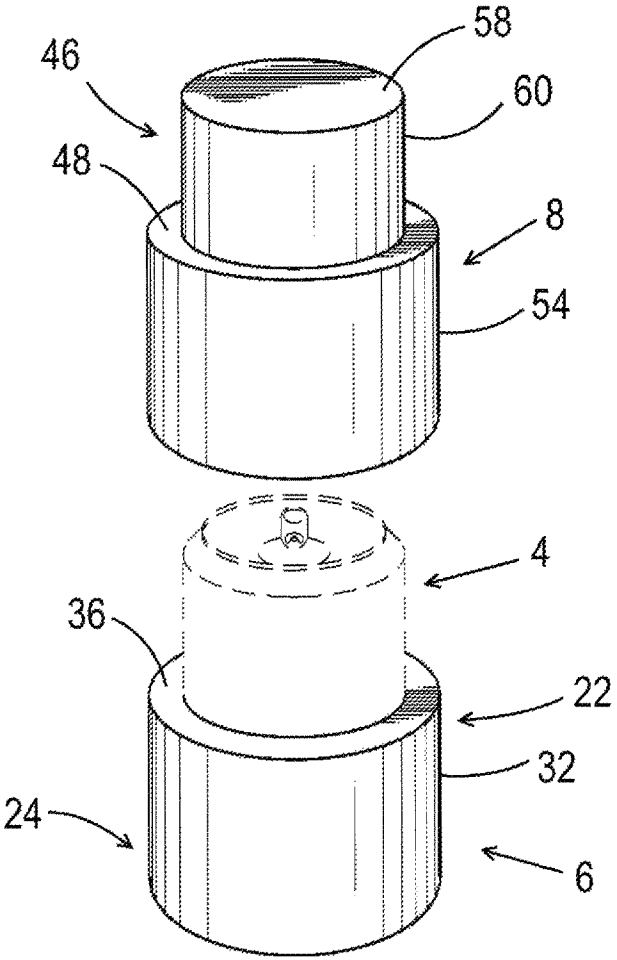
FIG. 2 is an exploded perspective view of the first embodiment of the beverage container insulator according to the invention showing a beverage container accommodated therein.
Figure 1:
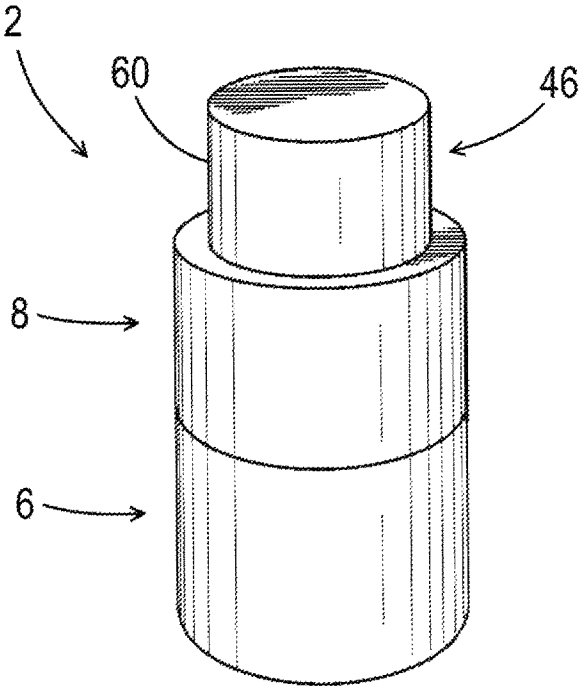
FIG. 1 is a pictorial view of a first embodiment of a beverage container insulator according to the invention shown in an assembled state for accommodating a beverage container.
Figure 5:
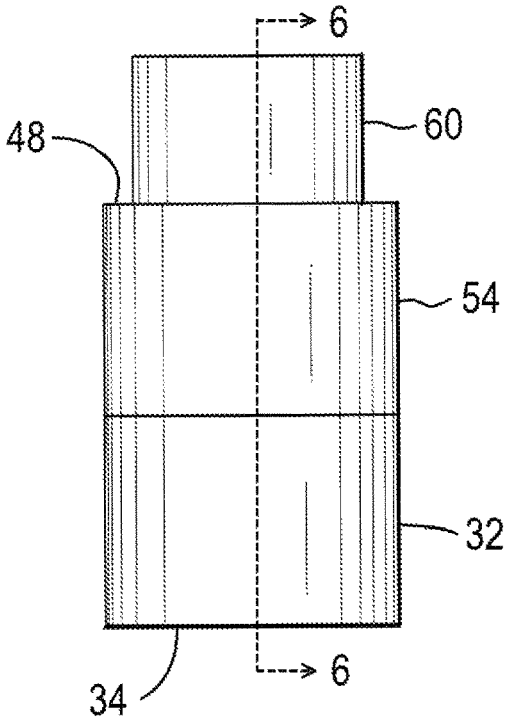
FIG. 5 is an elevation view of the first embodiment of the beverage container insulator according to the invention shown in an assembled state for accommodating a beverage container.
Figure 6:
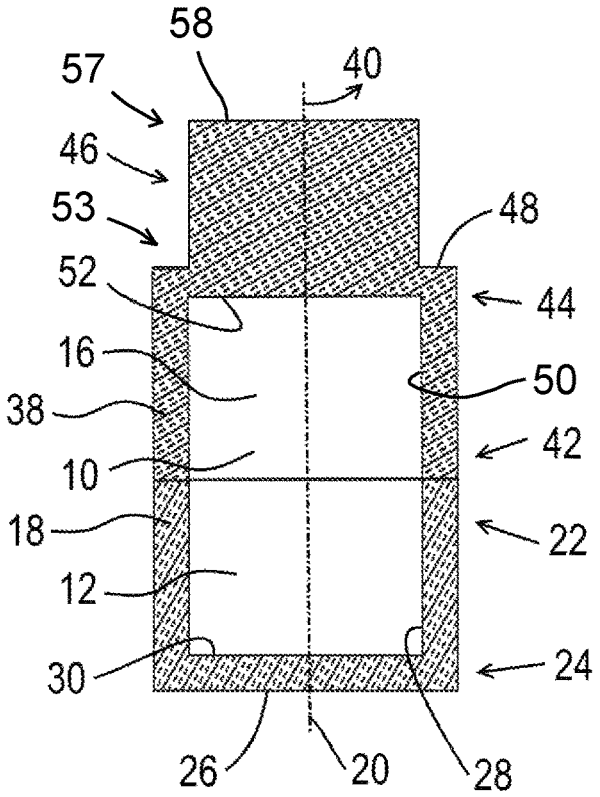
FIG. 6 is a cross sectional view of the first embodiment of the beverage container insulator according to the invention taken along line 6-6 of FIG. 5.

Turning now to FIGS. 1-8, a brief description concerning the various components of a first embodiment of the present invention will now be briefly discussed. As can be seen in this embodiment, the present invention relates to a beverage container insulator 2 which completely encloses beverage containers 4 such as conventional 10-20 oz cans or bottles for insulating the beverage contained therein and preventing the entrance of foreign matter, debris, insects and/or bugs. Specifically, the beverage container insulator 2 according to the first embodiment is described in relation to a conventional 10-20 oz can, e.g., soda can, beer can or the like. Hereinafter the beverage container insulator 2 will simply be referred to as insulator 2. The insulator 2 includes two individual components namely a base element 6 and a cover element 8 that can be arranged in an assembled state, as shown in FIGS. 1, 5, and 6, to form an enclosed internal chamber 10 which fully receives a beverage container 4. The base element 6 is in the form of a cup having an open compartment, hollow or cavity 12 which receives a lower portion of the beverage container 4 therein and leaves an upper portion of the beverage container 4 exposed. The cover element 8 forms an open compartment, hollow or cavity 16 which receives the upper portion of the beverage container 4 therein and leaves the lower portion of the beverage container 4 exposed. It is to be appreciated that reference to lower and upper portions of the beverage container 4 is merely relative. That is to say, the entirety of the beverage container 4 is divided into a lower portion and an upper portion and these portions are not intended specify certain segments or sections of the beverage container 4 such as the lower 50% and the upper 50% of the beverage container 4.

Figure 8:
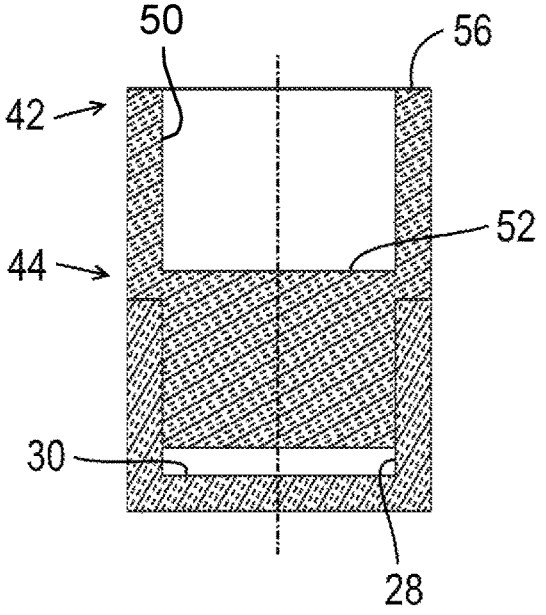
FIG. 8 is a cross sectional view of the first embodiment of the beverage container insulator according to the invention taken along line 8-8 of FIG. 7.
Figure 12:
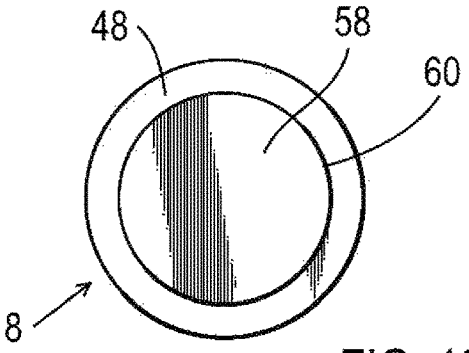
FIG. 12 is a top view of the second embodiment of the beverage container insulator according to the invention.
Figure 9:
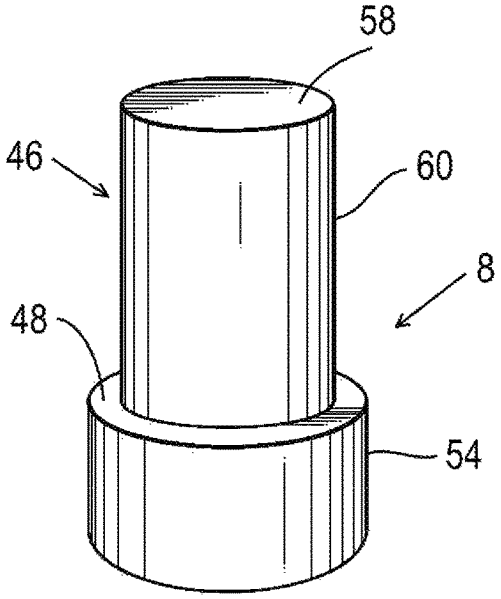
FIG. 9 is a pictorial view of a second embodiment of the beverage container insulator according to the invention shown in an assembled state for accommodating a beverage container.
Figure 9:
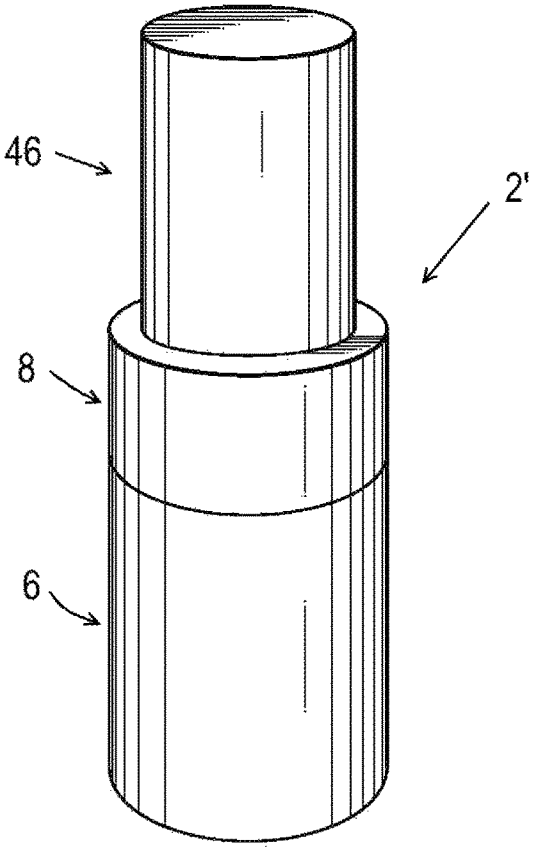
Figure 10:
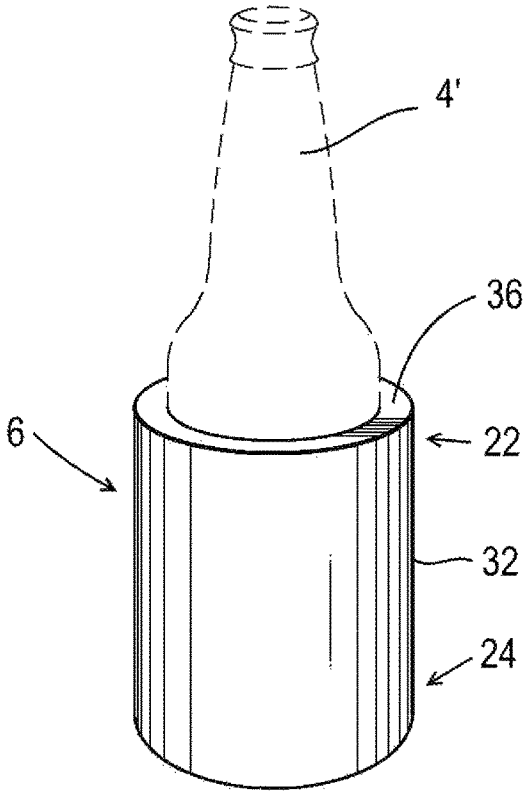
FIG. 10 is an exploded perspective view of the second embodiment of the beverage container insulator according to the invention showing a beverage container accommodated therein.
Figure 11:
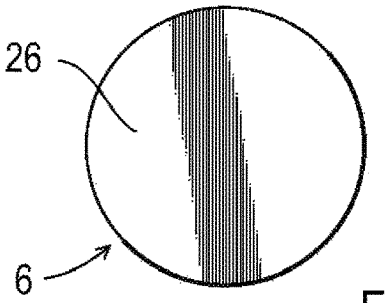
FIG. 11 is a bottom view of the second embodiment of the beverage container insulator according to the invention.

The base element 6 of the insulator 2 is formed by a hollow cylindrical base sidewall 18 that defines a central longitudinal axis 20 and has an open second end 22 and a closed first end 24. A transverse, circular end wall 26 is located at and closes the first end 24 of the base sidewall 18. As shown in FIGS. 6 and 8, the base sidewall 18 and the end wall 26 are formed together as a single unit. However it is to be appreciated that the base sidewall 18 and the end wall 26 can be individual elements that are connected together such as by material bonding for example. The base sidewall 18 has a cylindrical interior surface 28 which together with an interior surface 30 of the end wall 26 delimit the cavity 12 of the base element 6. The interior surface 28 of the base sidewall 18 has a diameter that closely corresponds to or is the same as an outer diameter of the beverage container 4 such that a moderate interference fit is formed between the base element 6 and the beverage container 4 when a lower portion of the beverage container 4 is inserted into the cavity 12 of the base element 6. Preferably the diameter of the interior surface 28 of the base sidewall 18 is between about 2.25 to 2.75 inches, or more preferably the diameter of the interior surface 28 of the base sidewall 18 is approximately 2.5 inches. The base sidewall 18 has a material thickness, i.e., a radial dimension from the interior surface 28 to an exterior surface 32 of the base sidewall 18, that generally depends on the type of material used to form the insulator 2 and the desired insulating properties and structural characteristics of the insulator 2. For example, the insulator 2 can be made from a material having good insulating properties and beneficial structural characteristics, e.g., polymeric foam, styrofoam, a low density polystyrene foam or closed cell neoprene rubber for example. Preferably the material thickness of the base sidewall 18 is between about 0.375 inch to 0.75 inch, or more preferably the material thickness of the base sidewall 18 is approximately 0.625 inch. Generally, the material thickness of the end wall 26, i.e., an axial dimension from the interior surface 30 to an exterior surface 34 of the end wall 26, is the same as the material thickness of the base sidewall 18, however it may different than the material thickness of the base sidewall 18. Preferably the material thickness of the end wall 26 is between about 0.375 inch to 0.75 inch, or more preferably the material thickness of the end wall 26 is approximately 0.625 inch. The open second end 22 of the base sidewall 18 has an axially facing annular second end surface 36 that mates with the cover element 8 when the insulator 2 is arrange in the assembled state. An axial length of the base element 6, i.e., axial distance between second end surface 36 of the base sidewall 18 to the exterior surface 34 of the end wall 26 is preferably between about 2 to 3 inches, or more preferably the axial length of the base element 6 is approximately 2.5 inches. As such, when the lower portion of the beverage container 4 is inserted into the cavity 12 of the base element 6 until it abuts the interior surface 30 of the end wall 26, the base sidewall 18 axially encloses about ¼ to ¾ of an axial length of the cylindrical portion of the beverage container 4, or more preferably about ½ of the axial length of the cylindrical portion of the beverage container 4. It should be recognized that conventional beverage containers 4, 4' typically comprise a generally cylindrical portion and may also include a portion that has a non-cylindrical profile or is more narrow than the cylindrical portion. For example, almost an entirety of conventional 10-20 oz aluminum beverage cans is cylindrical, whereas conventional 10-20 oz glass or plastic bottles (as described below in relation to the second embodiment) generally have an extended narrow neck that extends from the cylindrical portion. The important aspect regarding the axial length of the base element 6 is, that when the beverage container 4 is inserted into the base element 6, a sufficient amount, i.e., axial length, of the cylindrical portion of the beverage container 4 must remain exposed so as to enable the cover element 8 to form a moderate interference fit with the beverage container as will be described below.

The cover element 8 of the insulator 2 is formed by a hollow cylindrical cover sidewall 38 that defines a central longitudinal axis 40 which generally coaxially aligns with the central longitudinal axis 20 of the base element 6 in both the assembled and interconnected states. A first end 42 of the cover sidewall 38 is open whereas an opposite second end 44 of the cover sidewall 38 is closed by means of a cylindrical insert 46. The second end 44 of the cover sidewall 38 has an annular second end surface 48 from which the insert 46 axially extends concentrically with the cover sidewall 38. As shown in FIGS. 6 and 8, the cover sidewall 38 and the insert 46 can be formed together as a single unit. However it is to be understood that the cover sidewall 38 and the insert 46 can be individual elements that are connected together such as by material bonding for example. The cover sidewall 38 has a cylindrical interior surface 50 which together with an end surface 52 at a proximal end 53 of the insert 46 delimit the cavity 16 of the cover element 8. The interior surface 50 of the cover sidewall 38 has a diameter that closely corresponds to or is the same as an outer diameter of the beverage container 4 such that a moderate interference fit is formed between the cover element 8 and the beverage container 4 when the cover element 8 is placed over the upper portion of the beverage container 4 with the upper portion of the beverage container 4 being received in the cavity 16 of the cover element 8, such as when the insulator 2 is arranged in the assembled state. Preferably the diameter of the interior surface 50 of the cover sidewall 38 is between about 2.25 to 2.75 inches, or more preferably the diameter of the interior surface 50 of the cover sidewall 38 is approximately 2.5 inches. Like the base sidewall 18 described above, the cover sidewall 38 has a material thickness, i.e., a radial dimension from the interior surface 50 to an exterior surface 54 of the cover sidewall 38, that generally depends on the type of material used to form the insulator 2 and the desired insulating properties and structural characteristics of the insulator 2. Preferably the material thickness of the cover sidewall 38 is between about 0.375 inch to 0.75 inch, or more preferably the material thickness of the cover sidewall 38 is approximately 0.625 inch. The open first end 42 of the cover sidewall 38 has an axially facing annular first end surface 56 and an axial length of the cover sidewall 38, i.e., axial distance between the first and the second end surfaces 56, 48 of the cover sidewall 38 is preferably between about 2 to 3 inches, or more preferably the axial length of the cover sidewall 38 is approximately 2.5 inches. As briefly described above, the important aspect regarding the axial length of the cover sidewall 38 is that when the beverage container 4 is received into the cover element 8, the first end surface 56 of the cover sidewall 38 mates with the second end surface 36 of the base sidewall 18 so as to completely enclose the beverage container 4 within the internal chamber 10 of the insulator 2. That is to say in other words, when the cover element 8 and the base element 6 are arranged in the assembled state with the beverage container 4 enclosed therein, the upper portion of the beverage container 4, i.e., the portion of the beverage container 4 not received within the base element 6, is fully received into the cavity 16 of the cover element 8. It should be recognized that the axial length of the cavity 16 of the cover element 8 can be greater than the length of the upper portion of the beverage container 4.

Figure 7:
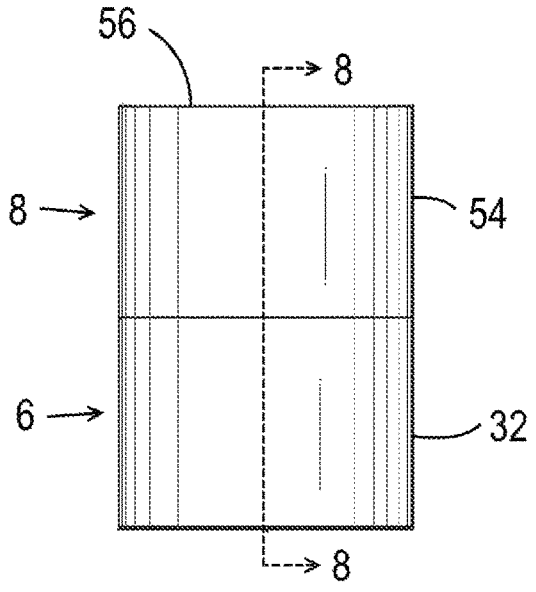
FIG. 7 is an elevation view of the first embodiment of the beverage container insulator according to the invention shown in an interconnected state.

The cylindrical insert 46 has a proximal end 53 and an axially opposite remote end 57. The insert 46 extends from the second end surface 48 of the cover sidewall 38 and is generally arranged concentric therewith. The insert 46 has an exterior surface 60 with an outer diameter that closely corresponds to or is the same as the outer diameter of the beverage container 4 and thus closely corresponds to or is the same as the diameter of the interior surface 28 of the base sidewall 18. Preferably the outer diameter of the insert 46 is between about 2.25 to 2.75 inches, or more preferably the outer diameter of the insert 46 is approximately 2.5 inches. Due to the corresponding outer diameter of the insert 46 and the diameter of the interior surface 28 of the base sidewall 18, a moderate interference fit is formed between the exterior surface 60 of the insert 46 and the interior surface 28 of the base element 6 when the insert 46 is inserted into the cavity 12 of the base element 6. For example, when the insulator 2 is not being utilized to insulate a beverage, i.e., the internal chamber 10 does not contain a beverage container 4, the insert 46 can be inserted into the cavity 12 of the base element 6 so as to couple the cover element 8 and the base element 6 to each other. This arrangement of the cover element 8 and the base element 6 is referred to as the interconnected state of the insulator 2. In the interconnected state, as shown in FIGS. 7 and 8, loss or separation of one of the cover element 8 and the base element 6 can be prevented when the insulator 2 is placed into storage, for example. The exterior surface 60 of the insert 46 has length, i.e., the distance from the second end surface 48 of the cover sidewall 38 to an exterior end surface 58 at the remote end 57 of the insert 46 is preferably between about 1.25 to 1.75 inches, or more preferably the length of the exterior surface 60 of the insert 46 is approximately 1.5 inches. Although not necessary, it is beneficial for the entire axial length of the exterior surface 60 of the insert 46 to mate with the interior surface 28 of the base sidewall 18 since the more contact between the two surfaces 28, 60, the stronger the interference fit therebetween. In this case, if the axial length of the exterior surface 60 of the insert 46 is shorter than the axial length of the cavity 12 of the base element 6, the insert 46 can be inserted into the cavity 12 of the base element 6 until the second end surface 48 of the cover sidewall 38 abuts the second end surface 36 of the base side wall 18.

FIGS. 9-16 show a second embodiment of the beverage insulator 2 of the present invention. As the second embodiment is similar, in many respects, to the previously discussed first embodiment, only the differences between the second embodiment and the first embodiment will be discussed in detail while identical elements or elements with identical functions will be given identical reference numerals in the drawings.

The differences between the first and the second embodiments relate to the different types or styles of beverage containers 4, 4' that can be accommodated within the beverage container insulator 2, namely the differences between the two embodiments of the insulator 2 stem from the differences in the shapes and sizes of the beverage containers 4, 4'. The beverage container insulator 2 according to the second embodiment is described in relation to a conventional 10-20 oz bottle, e.g., soda bottle, beer bottle or the like.

From the figures, it is clear to see that the second embodiment of the insulator has a greater axial length than the insulator according to the first embodiment. Due to the typically longer axial length of a conventional 10-20 oz bottle in comparison with that of a convention a 10-20 oz can, the main differences between the first and the second embodiments relate to the corresponding axial dimensions of the insulators, with the second embodiment of the insulator 2 having a generally longer overall axial length than that of the insulator 2 according to the first embodiment. The axial length of the base element 6 according to the second embodiment, i.e., the axial distance between second end surface 36 of the base sidewall 18 to the exterior surface 34 of the end wall 26 is preferably between 3.5 to 4.5 inches, or more preferably the axial length of the base element 6 according to the second embodiment is approximately 4 inches. As such, when the lower portion of the beverage container 4' is inserted into the cavity 12 of the base element 6 and abuts the interior surface 30 of the end wall 26, the base sidewall 18 axially encloses about ½ to ¾ of an axial length of the cylindrical portion of the beverage container 4', or more preferably about ⅝ of the axial length of the cylindrical portion of the beverage container 4'. The important aspect of the axial length of the base element 6 is that with the beverage container 4' fully received within the cavity 12 of the base element 6, a sufficient length of the cylindrical portion thereof should remain exposed such that the interference fit between the cover element 8 and the beverage container 4' is able to maintain the assembled state of the insulator 2, i.e., prevent the cover element 8 from disengaging or being knocked off the upper portion of the beverage container 4'.

In the second embodiment, the cover element 8 comprises a hollow cylindrical cover sidewall 38 having an interior surface 50 that defines a cover sidewall cavity 62. The insert 46 of the second embodiment is formed by a hollow cylindrical insert sidewall 64 having a proximal end 53, a remote end 57 and an interior surface 66 extending therebetween. In this case, the remote end 57 of the insert 46 has an end surface 55 that encloses the remote end 57 while the proximal end 53 of the insert 46 is open to the cover sidewall cavity 62. The end surface 55 of the remote end 57 of the insert 46 together with the interior surface 66 of the insert sidewall 64 define an insert cavity 68. The proximal end 53 of the insert sidewall 64 is connected to the second end 44 of the cover sidewall 38 such that the cover sidewall cavity 62 and the insert cavity 68 together form the cavity 16 of the cover element 8. As shown in FIGS. 14 and 16, a diameter of the interior surface 66 of the insert sidewall 64 is less than a diameter of the interior surface 50 of the cover sidewall 38. The relative diameters of the interior surfaces 50, 66 of the cover and insert sidewalls 38, 64 generally depends of the material thickness of these sidewalls 38, 64 and the outer diameter of the insert 46, i.e., the outer diameter of the cylindrical portion of the beverage container 4' and the corresponding diameter of the interior surface 28 of the base sidewall 18. The cover sidewall cavity 62 and the insert cavity 68 are aligned along the longitudinal axis 40 and together delimit the cavity 16 of the cover element 8. In order to accommodate the elongate upper portion of the beverage container 4' according to the second embodiment including the narrow neck of the beverage container 4', the axial length of the cover sidewall 38, i.e., the axial distance between the first and the second end surfaces 56, 48 of the cover sidewall 38, is between 1.75 to 2.25 inches, or more preferably the axial length of the cover sidewall 38 is approximately 2 inches and the axial length of the insert 46, i.e. the axial distance from the second end surface 48 of the cover sidewall 38 to the exterior end surface 58 at the remote end 57 of the insert 46 is between 3.5 to 4.0 inches, or more preferably the axial length of the insert 46 is approximately 3.75 inches.

Figure 20:
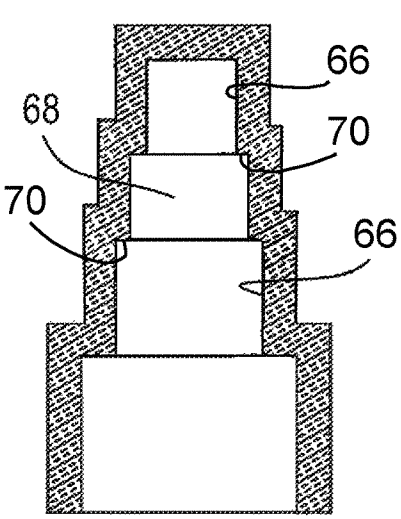
FIG. 20 is a further cross sectional view of the cover element of the beverage container insulator.
Figure 19:
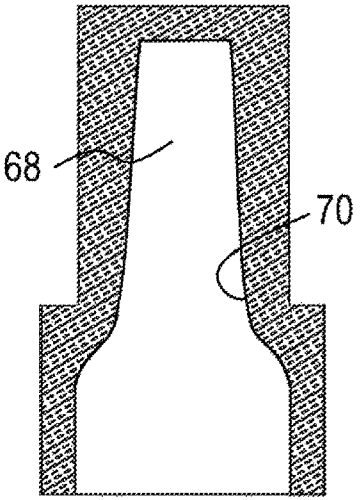
FIG. 19 is another cross sectional view of the cover element of the beverage container insulator.
Figure 18A:
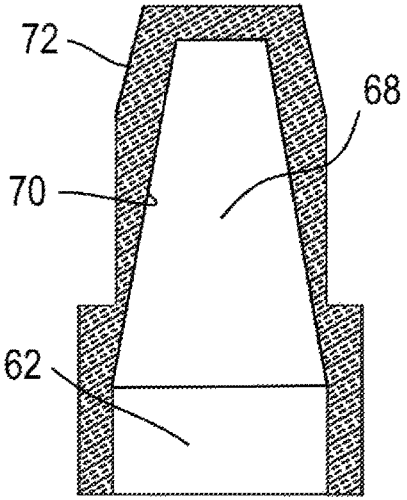
FIG. 18A is a cross sectional view of the cover element of the beverage container insulator taken along line 18A-18A of FIG. 18.

As shown in FIGS. 14, 16, 18A, 19 and 20 due to the difference in the diameters of the interior surfaces 50, 66 of the cover and insert sidewalls 38, 64, the cover element 8 has an intermediate surface 70 extending therebetween that slopes inwardly toward the interior surface 66 of the insert sidewall 64. The intermediate surface 70 is generally axially located at the second end 44 of the cover sidewall 38 and the proximal end 53 of the insert 46, i.e., adjacent the union between the cover sidewall 38 and the insert 46. It is noted that the cross sectional profile of the intermediate surface 70 can be conical and extend from the cylindrical interior cover sidewall 50 either only part of the way along the length of the insert 46 to the cylindrical interior surface 66 of the insert sidewall 64 (FIG. 14) or can extend to all the way along the length of the insert 46 to the end surface 55 of the remote end 57 of the insert 46 (FIG. 18A). In this case, the intermediate surface 70 is considered to be the interior surface of the insert sidewall 64. The cross sectional profile of the intermediate surface 70 can also be partly curved and partly conical as shown in FIG. 19. In another variation, the insert 64 can have a stepped profile with the cylindrical interior surface 66 having a plurality of laterally extending intermediate surface portions 70 as shown in FIG. 20. In each of these variations though, it is to be understood that from the essentially cylindrical interior surface 50 of the cover sidewall 38, the diameter of the cavity 16 of the cover element 8 decreases toward the remote end 57 of the insert 46. The important aspect of the intermediate surface 70 as well as the interior surfaces 50, 66 of the cover and insert sidewalls 38, 64 is that they closely correspond to the profile of the upper portion of the beverage container 4' and that the cavity 16 of the cover element 8 fully receives the upper portion of the beverage container 4' without preventing the first end surface 56 of the cover sidewall 38 from contacting the second end surface 36 of the base sidewall 18 when the base element 6 and the cover element 8 are arranged in the assembled state.

Figure 21:
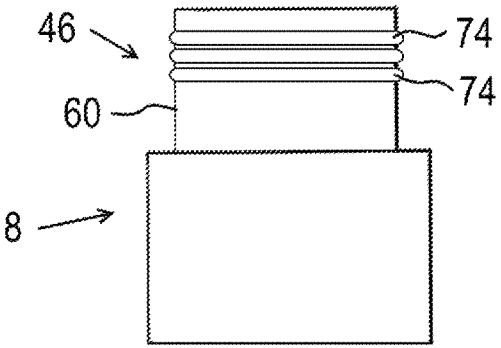
FIG. 21 is a partial elevation view of the cover element of the beverage container insulator according to the invention.
Figure 18:
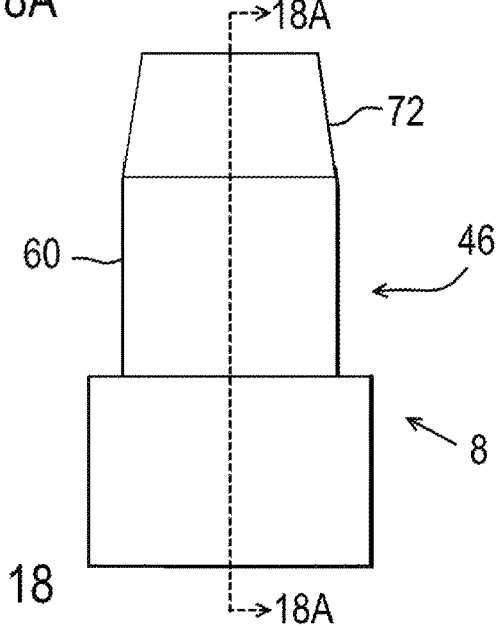
FIG. 18 is an elevation view of cover element of the beverage container insulator according to the invention.
Figure 17A:
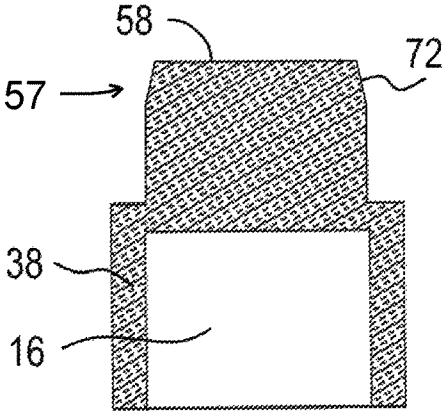
FIG. 17A is a cross sectional view of the cover element of the beverage container insulator taken along line 17A-17A of FIG. 17.
Figure 17:
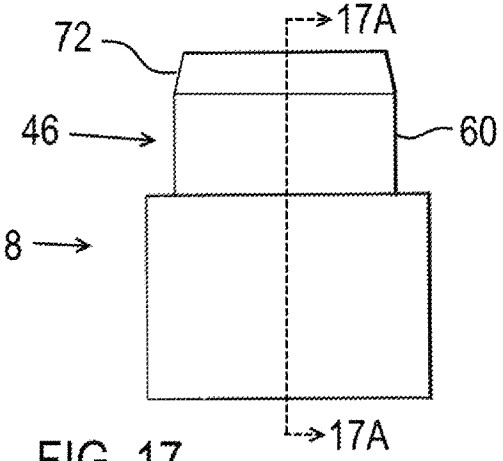
FIG. 17 is an elevation view of cover element of the beverage container insulator according to the invention.

FIGS. 17-21 show further variations of the insert 46 of the cover element 8 according to the invention. As shown in FIG. 17-18A, adjacent the remote end 57 of the inset 46, the exterior surface 60 thereof has a surface 72 that is chamfered or beveled radially inward. The beveled surface 72 helps to guide or align the insert 46 of the cover element 8 as it is inserted into the cavity 12 of the base element 6 when arranging the insulator 2 in the interconnected state. As shown in FIG. 21 the exterior surface 60 of the insert 46 can comprise one or more ribs 74 that either partially or fully extend about the circumference of the insert 46. The annular ribs 74 help to enhance or rather strengthen the interference fit between the insert 46 of the cover element 8 and the base element 6 when the insert 46 is inserted into the cavity 12 of the base element 6.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

I claim:

1. A beverage container insulator for accommodating a beverage container therein, the beverage container insulator comprising:

a base element having an open end and an axially opposite closed end and defining an interior cavity;

a cover element comprising a cover sidewall and first and second axially opposite ends, the first end of the cover element being open, an insert being connected to the second end of the cover element, and the cover element defining an interior cavity;

the cover element and the base element are arrangeable in an assembled state to accommodate the beverage container within an internal chamber being formed by the interior cavity of the base element and the interior cavity of the cover element, the cover element and the base element are further arrangeable in an interconnected state to couple the cover element and the base element to each other;

in the assembled state of the cover element and the base element, the interior cavity of the base element receives a first portion of the beverage container therein and the interior cavity of the cover element receives a remaining second portion of the beverage container therein to completely enclose the beverage container within the internal chamber; and in the interconnected state of the cover element and the base element, the insert of the cover element is received within the interior cavity of the base element and an interference fit is formed between the insert of the cover element and the base element; and the cover sidewall has laterally extending first and second annular surfaces that are located at the open first end and the second end of the cover sidewall, respectively, and the insert has a proximal end that is connected to the second end of the cover sidewall, the proximal end of the insert comprising an interior end surface, the insert has a remote end being opposite the proximal end and having an exterior end surface.

2. A beverage container insulator for accommodating a beverage container therein, the beverage container insulator comprising:

a base element having a base sidewall and an end wall, the base sidewall being cylindrical and defining a longitudinal axis, the base sidewall having an open end and an axially opposite closed end that is closed by the end wall, the base sidewall and the end wall defining an interior cavity;

a cover element comprising a cylindrical cover sidewall and a cylindrical insert that define a longitudinal axis, the cover sidewall having a first end that is open and an axially opposite second end, the insert being connected to the second end of the cover sidewall and having an interior end surface, and at least the interior end surface of the insert and an interior surface of the cover sidewall defining an interior cavity;

the cover and the base elements are arrangeable in an assembled state to accommodate the beverage container within an internal chamber that is formed by the interior cavity of the base element and the interior cavity of the cover element, the cover and the base elements are further arrangeable in an interconnected state to couple the cover element and the base element to each other;

in the assembled state, the interior cavity of the base element receives a first portion of the beverage container therein and the interior cavity of the cover element receives a remaining second portion of the beverage container therein to completely enclose the beverage container within the internal chamber; and in the interconnected state, the insert of the cover element is received within the interior cavity of the base element and mates with the base sidewall; and the cover sidewall has laterally extending first and second annular surfaces being located at the open first end and the second end of the cover sidewall, respectively, and the insert has a proximal end being connected to the second end of the cover sidewall, the proximal end of the insert comprising the interior end surface of the insert, the insert has a remote end being opposite the proximal end and having an exterior end surface.

3. The beverage container insulator according to claim 2, wherein the base sidewall and the cover sidewall are axially dimensioned such that in the assembled state of the cover element and the base element, when the beverage container is received within the internal chamber, the first annular surface of the cover sidewall mates with an end surface at the open end of the base sidewall.

4. The beverage container insulator according to claim 2, wherein the base sidewall having an interior surface with a diameter corresponding to a diameter of an exterior surface of the insert such that, when the cover element and the base element are arranged in the interconnected state, an interference fit is formed between the interior surface of the base sidewall and the exterior surface of the insert.

5. The beverage container insulator according to claim 4, wherein the diameter of the interior surface of the base sidewall, the diameter of the exterior surface of the insert and a diameter of the interior surface of the cover sidewall correspond to each other and to an outer diameter of the beverage container.

6. The beverage container insulator according to claim 2, wherein, in the assembled state of the cover element and the base element, the first annular surface of the cover sidewall mates with a lateral annular surface of the base sidewall located at the open end of the base sidewall to completely enclose the internal chamber.

7. The beverage container insulator according to claim 2, wherein, in the interconnected state of the cover element and the base element, the insert is received within the interior cavity of the base element and the second annular surface of the cover sidewall mates with a lateral annular surface of the base sidewall located at the open end of the base sidewall.

8. The beverage container insulator according to claim 7, wherein the base sidewall having an interior surface with a diameter corresponding to a diameter of an exterior surface of the insert such that, when the cover element and the base element are arranged in the interconnected state, an interference fit is formed between the interior surface of the base sidewall and the exterior surface of the insert.

9. The beverage container insulator according to claim 1, wherein, in the assembled state of the cover element and the base element, the first annular surface of the cover sidewall mates with a laterally extending annular surface of the base sidewall located at the open end of the base sidewall to completely enclose the internal chamber.

10. The beverage container insulator according to claim 1, wherein, in the interconnected state of the cover element and the base element, the insert is received within the interior cavity of the base element and the second annular surface of the cover sidewall mates with a laterally extending annular surface of the base sidewall located at the open end of the base sidewall.

11. The beverage container insulator according to claim 10, wherein the base sidewall having an interior surface with a diameter corresponding to a diameter of an exterior surface of the insert sidewall such that, when the cover element and the base element are arranged in the interconnected state, an interference fit is formed between the interior surface of the base sidewall and the exterior surface of the insert sidewall.

12. A beverage container insulator for accommodating and completely enclosing a beverage container therein, the beverage container insulator comprising:

a base element having a cylindrical base sidewall which defines a longitudinal axis, the base sidewall having an open end and a closed end, the open end of the base sidewall having a laterally extending, first annular surface and the closed end of the base sidewall being closed by an end wall, an interior surface of the base sidewall and an interior surface of the end wall defining an interior cavity of the base element;

a cover element having a cylindrical cover sidewall which defines a longitudinal axis, the cover sidewall having an open first end and an axially opposite second end, the first end of the cover sidewall having a laterally extending, first annular surface, and the second end of the cover sidewall having a laterally extending, second annular surface and being integrally formed with a cylindrical insert which is coaxially aligned with the cover sidewall, the insert axially extends from the second end of the cover sidewall in a direction opposite from the first end of the cover sidewall, the insert has a proximal end with an end wall that directly connects to and closes the second end of the cover sidewall such that an interior surface of the cover sidewall and the insert define an interior cavity of the cover element;

the base element and the cover element are dimensioned such that, in an assembled state of the base element and the cover element, the first annular surface of the base sidewall mates with the first annular surface of the cover sidewall, the interior cavity of the base element and the interior cavity of the cover element form an internal chamber which receives and completely encloses an entirety of the beverage container therein; and the insert having an exterior surface with an outer diameter that corresponds to an inner diameter of the interior surface of the base sidewall such that, in an interconnected state of the base element and the cover element, the insert of the cover element is received within the interior cavity of the base element, the second annular surface of the cover sidewall mates with the first annular surface of the base sidewall and an interference fit is formed between the interior surface of the base sidewall and the exterior surface of the insert.

* * * * *